United States Patent [19]

Koschinek et al.

[11] Patent Number: 4,461,740

[45] Date of Patent: Jul. 24, 1984

[54] PROCESS FOR SPIN-STRETCHING OF HIGH STRENGTH TECHNICAL YARNS

[75] Inventors: Gunter Koschinek, Dietzenbach; Dietmar Wandel, Hanau; Ludger Thone, Munster, all of Fed. Rep. of Germany

[73] Assignee: Davy McKee A.G., Fed. Rep. of Germany

[21] Appl. No.: 500,797

[22] Filed: Jun. 6, 1983

Related U.S. Application Data

[63] Continuation of Ser. No. 281,593, Jul. 9, 1981, abandoned.

[30] Foreign Application Priority Data

Jul. 12, 1980 [DE] Fed. Rep. of Germany .....3026520

[51] Int. Cl.[3] ..... D01D 5/08

[52] U.S. Cl. ..... 264/210.8; 28/245; 264/290.5; 425/66

[58] Field of Search ..... 264/210.3, 290.5, 210.8; 28/245; 425/66

[56] References Cited

U.S. PATENT DOCUMENTS

| | | | |
|---|---|---|---|
| 3,715,421 | 2/1973 | Martin et al. | 264/130 |
| 3,745,151 | 7/1973 | Takeda et al. | 264/210.7 |
| 3,936,253 | 2/1976 | Fisher et al. | 264/210.8 |
| 4,042,662 | 8/1977 | Corbin et al. | 264/210.3 |
| 4,096,226 | 6/1978 | Martin et al. | 264/168 |

FOREIGN PATENT DOCUMENTS

| | | | |
|---|---|---|---|
| 48-32616 | 10/1973 | Japan | 264/210.8 |
| 50-25819 | 3/1975 | Japan | 264/210.8 |
| 51-45690 | 12/1976 | Japan | 264/210.8 |
| 53-122818 | 10/1978 | Japan | 264/210.8 |

*Primary Examiner*—Jay H. Woo

*Attorney, Agent, or Firm*—Allegretti, Newitt, Witcoff & McAndrews, Ltd.

[57] ABSTRACT

An improved process and apparatus for the spin-drawing of high-tenacity, technical-grade yarns is disclosed. The process and apparatus are particularly suitable for use with polyamide and polyester. High quality yarns having a low break elongation are obtained by maintaining the feed roll system at a constant temperature $T_E=(T_G-20°\ C.)$ to $(T_G+65°\ C.)$, wherein $T_G$ is the temperature of the glass transition point. Filaments are passed over a roll system disposed between the feed roll system and the draw roll system and driven at a peripheral speed between that of the feed roll and draw roll systems. The filaments are passed over the roll system a maximum of three turns.

6 Claims, 3 Drawing Figures

FIG. 2
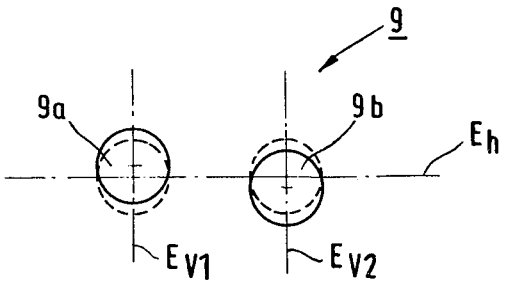
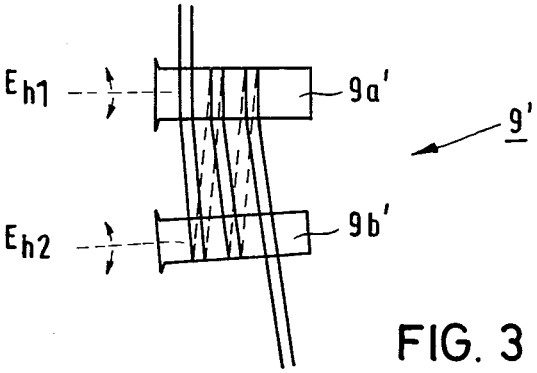
FIG. 3

PROCESS FOR SPIN-STRETCHING OF HIGH STRENGTH TECHNICAL YARNS

This application is a continuation of application Ser. No. 281,593, filed July 9, 1981 now abandoned.

BACKGROUND OF THE INVENTION

The invention relates to a process and an apparatus for the production of high-tenacity, technical-grade yarns, particularly of polyamide and polyester, by spin-drawing, in which the filaments extruded from a spinneret are cooled in a cooling zone by being expressed to a tranversely directed stream of air, are passed over a preparation device and then passed directly over several sets or systems of rolls, of which the first set consists of feed rolls. The continuous filament yarn, which forms a draw point, is drawn in at least one draw field, between at least two roll systems, of which the one following the draw field is a draw roll system. The yarn is subjected to a temperature of at least 160° C. in at least one roll system, and is finally passed over a set of let down rolls before it is wound up at a speed of at least 2,200 meters/min.

Technical-grade yarns are required to have specific properties, in particular a high tenacity, a low break elongation and a low incidence of yarn defects in the feed yarn. These requirements are technologically interrelated with high draw ratios in the production of feed yarn. Higher draw ratios, however, are limited where the continuous filament yarn has already been damaged by the drawing operation and breakage occurs. This limit is reached considerably earlier at high production speeds. The technical and economic merit of the spin-draw process at high-speed production can, however, be rated as positive only if, at the same time, the textile performance of the yarn is not impaired, and even improved.

From German published patent application DE-OS No. 1,435,467, a process for spin-drawing of polyester at speeds of 1,000 to 4,000 m/min. is known. The process disclosed therein utilizes a thermal treatment of the filaments at certain periods of residence time prior to drawing, the heating being effected on or between conical pins. The mechanical system used in the process is technically complicated and of little use since, for reasons of productivity, at least two continuous filament strands are to be processed on the pins.

U.S. Pat. No. 3,452,131 discloses a process for drawing polyamide filaments in which the filament yarn is orientation drawn in two stages and the yarn is additionally heated in the first stage by a gaseous medium.

German published patent application No. 1,912,299 discloses a spin-drawing process, in which a water deficient finish is applied to the filament and the drawing is effected in at least two stages, with the draw ratio of the first stage being between 1.15 and 3.0. The use of a snubbing pin, specified in the application, at high production speeds leads to a high amount of friction and hence to an uncontrollable increase in the temperature of the pin.

U.S. Pat. No. 4,003,974 discloses a process for spin-drawing of polyester. As an additional expedient in the drawing operation, a steam jet for heating the yarn to a temperature of 75°–250° C. is employed. Drawing is effected in a field between two sets of rolls.

Processes for spin-drawing of polyester are known from U.S. Pat. Nos. 3,790,995 and 3,715,421, in which the feed and draw rolls are provided with a certain surface roughness to allow a slippage of the filaments on both sets of rolls. However, it was found that, at higher production speeds, the filament slippage produced a high degree of friction and the frictional heat thus generated caused an uncontrollable increase in the temperature of the rolls.

SUMMARY OF THE INVENTION

It is the object of the present invention to provide a process and an apparatus for the spin-drawing of high-tenacity, technical-grade yarns at high production speeds to yeild high quality yarns having a low break elongation.

This object is achieved according to the process of the invention through the following steps:

(a) The feed roll system is maintained at a constant temperature $T_E=(T_G-20°\ C.)$ to $(T_G+65°\ C.)$, wherein $T_G$ is the temperature of the glass transition point;

(b) The filaments are passed over a roll system disposed between the feed roll system and the draw roll system. The roll system consists of at least two cylindrical rolls of which at least one is driven at a peripheral speed corresponding to less than or equal to the speed of the draw roll system and greater than or equal to the speed of the feed roll system. The driven roll system is maintained at a temperature $T_R$ between 75° C. and 215° C.;

(c) The filaments are passed around the roll system of (b) at a maximum of three turns or wraps;

(d) The draw roll system is maintained at a temperature $T_S \geqq 110°$ C., preferably $T_S \geqq 160°$ C., but is kept at a maximum of 20° C. below the polymer melting point; and (e) The relaxation or let down roll system is maintained at a temperature $T_A$, which is lower than 20° C. less than the polymer melting point, preferably $\leqq 110°$ C.

The process according to the invention has the following advantage in that it is a preferred application in the high-speed spin-drawing of polyamides and polyesters for the manufacture of yarns having a high tensile strength and a low break elongation. The process of the invention permits the use of a high draw ratio without having to contend with an increased incidence of yarn breakage. The bobbins of yarn thus obtained are suitable for direct use on a thread machine without requiring an additional draw step. By plying and twisting of feed yarn, a cord is produced which is used for further processing in textile manufacture. Thus, by combining the two process steps of spinning and drawing, the coupled spin-drawing process saves a separate operation, and, by employing high windup speeds, it becomes even more economical. The drawn yarns meet high quality requirements, as feed yarns, because of their predictable technical performance in the manufacture of woven textiles.

The driven roll system of the present invention divides the draw field defined by the feed roll system and the draw roll system into two zones: a zone in advance of the driven roll system, and a zone downstream of it. In contrast to conventional two zone draw technique, no orientation drawing takes place in the first zone because the first stage draw point is localized on the roll system itself. Thus, no drawing action is effected on the feed roll system. It only serves to impart to the filaments the optimal temperature required for the drawing operation. By this technique, the risk that the temperature of the feed rolls might be affected by the heat generated by friction and the drawing operation itself, which would result in undefined temperature conditions over the entire surface of the feed roll system or in an overheating of the filaments, respectively, is eliminated. If at least two continuous strands of filaments are processed on the same draw unit, the outcome for the two strands would be less than optimal, with the ultimate result of uneven and poor yarn properties.

The process, according to the invention, thus utilizes the two steps of "heating of the yarn to draw temperature" and "first-stage draw" in separate thermomechanical systems. Surprisingly, in addition to the positive effect on the temperature and a uniform heating of the yarn, a further beneficial aspect is realized. The localization of the draw point on the roll system is self-regulating due to the formation of a yarn tensioning gradient of the rolls.

The localization of the draw point on the roll system is determined by selecting a medium high number of yarn turns or wraps on the rolls and a medium speed of the rolls. Turns numbering more than three lead to a strong detention force so that the first stage draw point will not remain in the roll system, but will move into the first zone in advance of the rolls or onto the feed rolls. The self-regulating effect of the draw point localization would thus be lost. Speeds of the driven rolls which are lower than the speed of the feed rolls—the extreme case would be a stationary snubbing pin—likewise lead to such high detention forces that the run of the filament in the first zone in advance of the rolls becomes unstable and the rolls (or the snubbing pin) experience an uncontrollable increase in temperature. Such heating may be so severe as to cause a melt breaking of the filament.

By providing at least two rolls in the system, it is possible to exactly define the path of the yarn to keep it from being laterally displaced on the rolls. This permits a simultaneous processing of up to four strands of filaments without giving rise to mutual interference.

Normally, the localization of the draw point would primarily be determined by characteristic values, such as polymer homogeneity, the oil film and water content of the yarn, the preheating temperature, and the draw ratio. In conventional draw techniques, a shifting of the draw point back and forth on the rolls has been observed, which can be explained by fluctuations in the mentioned characteristics. The resulting yarn has nonuniform yarn properties. In the process of the invention, however, no drawing instability occurs because the draw point, by its localization within the roll system, is capable of self-regulating action to offset such fluctuations in the characteristic magnitudes, as opposed to systems in which the draw distribution is determined by mechanical considerations. In any event, the yarns made in accordance with the invention are of a good uniformity and yarn purity.

The process according to the invention may be carried further to best advantage through the step of passing the filaments over a stabilizer roll system arranged between the draw roll system and the relaxation or let down roll system. The temperature of the set of stabilizer rolls is maintained between 160° C. and a temperature of 20° C. below the polymer melting point, while the temperature of the set of relaxation rolls is maintained at $T_A \leqq 110°$ C.

Further process stages may successively follow the draw stage before the yarn is wound up. Such additional process stages may include treatment zones, relaxation zones and whirling devices.

The present invention also relates to an apparatus for carrying out the process, which comprises at least one spinneret, a blow duct, a preparation system, and several roll systems, of which the first comprises a set of feed rolls followed by a draw field. At least one of the several roll systems comprises a set of draw rolls disposed downstream of the draw field, and the last of the roll systems comprises a set of relaxation rolls followed by a windup mechanism.

In order to achieve the object of the invention, as previously stated, the apparatus includes a further set of rolls for localizing the draw point. This additional roll system is arranged in the draw field between the set of feed rolls and the set of draw rolls and consists of at least two cylindrical rolls, of which at least one is connected to drive means.

The advantages of the process of the invention are thus realized by the apparatus of the invention. It is of particular advantage if the rolls of the roll system are adapted to be adjustable in a mutually contrary relationship, especially if the roll system comprises two rolls whose axes are parallel, but are adjustable to each other in a skewed relationship of ±15 angular degrees.

The process and apparatus of the invention will be described in further detail with reference to a preferred embodiment illustrated in FIGS. 1–3 and several process examples given hereinafter. The characteristic values of all of the examples are summarized in a table at the end of the description.

BRIEF DESCRIPTION OF THE DRAWINGS

FIG. 2 shows the roll system 9 of FIG. 1, including rolls whose axes are located substantially in a horizontal plane and are vertically pivotable.

FIG. 3 is a modification of the roll system 9', according to FIG. 2, in which the roll axes are located substantially in a vertical plane and are horizontally pivotable.

DETAILED DESCRIPTION OF THE PREFERRED EMBODIMENTS

Figure 1:
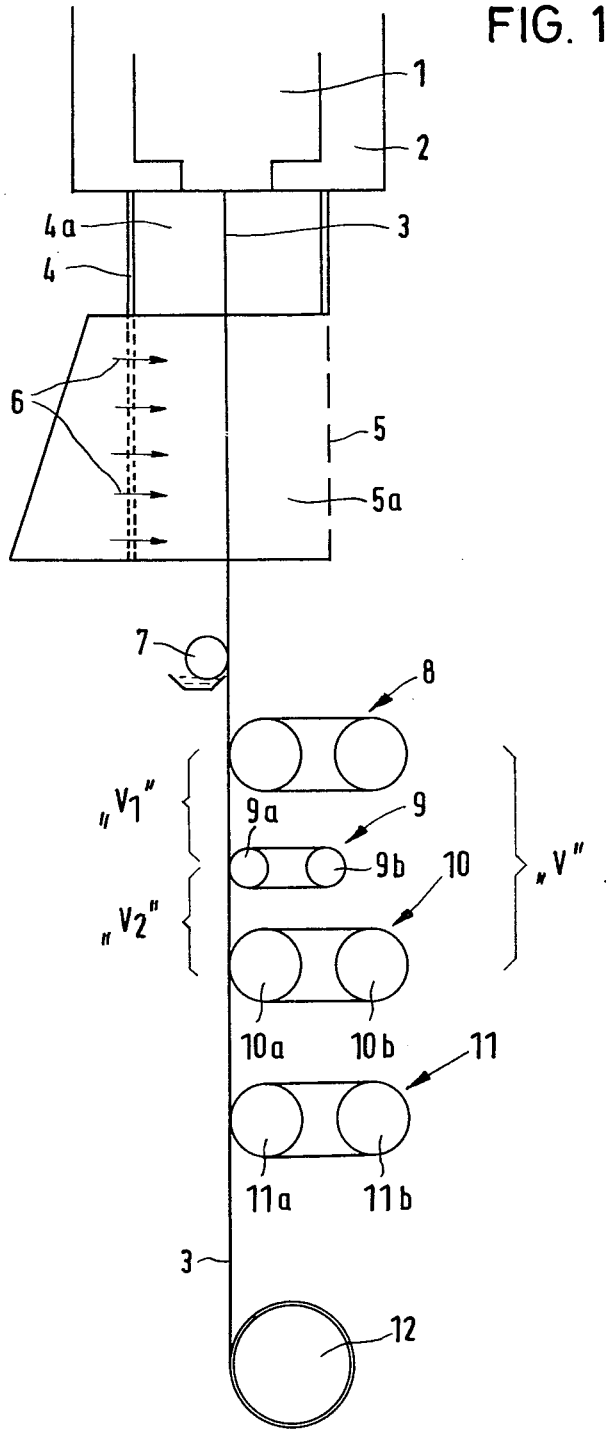
FIG. 1 is a diagrammatic illustration of an apparatus in accordance with a preferred embodiment of the process.

Referring to FIG. 1, a spinneret 1 has a multiplicity of orifices or holes in a spinning block 2. Filaments 3, which subsequently form continuous filament strands or yarn, are extruded from the spinneret 1 and are passed through a heater 4 enclosing a heating zone 4*a*. The filaments 3 then pass through a blow duct 5, enclosing a cooling zone 5*a*, in which the filaments are cooled by an air current blowing in the direction of the arrows 6.

Below the blow duct 5, a preparation system 7 is arranged by which a finish or preparation is applied to the filaments. This is followed by a set of feed rolls 8 over which the yarn 3 is passed. The filaments are then further passed over a system of rolls 9 and a system of draw rolls 10. The space between the feed rolls 8 and the system of draw rolls 10 is referred to as draw field "V". The set of rolls 9*a* and 9*b* is the roll system by which the draw field V is divided into two zones $V_1$ and $V_2$, and, in which the draw point is localized. Each of the rolls 9*a* and 9*b* has the same diameter, between 40 mm and the diameter of the draw rolls 10*a* and 10*b*, and both rolls are driven at the same speed. The continuous filament strand is passed over the roll system 9 either parallel to it, as shown in FIG. 1, or by making an 8-wrap about the rolls.

Following the set of draw rolls 10 is a set of relaxation or let down rolls 11, forming a "duo", like the roll systems 8 and 10, i.e. there are two rolls, 11*a* and 11*b*. Finally, the apparatus is completed by a yarn takeup device 12 for the yarn 3.

FIG. 2 shows the various positions to which the set of rolls 9 of FIG. 1 may be adjusted. The axes of the rolls 9*a* and 9*b* lie substantially in a horizontal plane $E_h$, but are adapted to be pivoted in vertical planes $E_{h1}$ and $E_{h2}$ in a mutually contrary relationship about one pivot plane, i.e. by a maximum of ±15 angular degrees, so that an oblique or skewed position with respect to each roll is obtained.

FIG. 3 shows the possible adjustments of an alternative roll system 9', analogous to that illustrated in FIG. 2. The axes of the rolls 9*a'* and 9*b'* are located substantially in a vertical plane, which is identical with the plane of the drawing. They are adjustable about one pivot point in a mutually contrary relationship in substantially horizontal planes $E_{h1}$ and $E_{h2}$, which are perpendicular to the plane of the drawing, likewise by a maximum of ±15 angular degrees.

The present invention can be better understood with reference to the following examples. Characteristic values used in the following examples are based on the following measuring procedures: Tenacity and break elongation were measured on conventional tensile testing equipment. The reference elongation was determined from the load extension diagram of the yarn. The reference elongation is defined as the elongation of the yarn at a force of 4.85 g/dtex.

EXAMPLE 1

Polyamide-6 having a relative viscosity $n_{rel}$ of 3.3 was melted at 293° C. and was passed at a rate of 247 g/min through two spinneret plates each having 140 holes, each hole having a diameter of 0.4 mm.

The extruded filaments were passed through a 600 mm long heater, having a wall temperature of 300° C., and were subsequently passed through a 1100 mm long blow duct in which they were cooled by a transversely directed air current blowing at a speed of 0.8 meters/sec.

Thereafter, a 99% preparation was applied to the filaments by means of rolls, so that the oil film on the finished yarn was 1.1%. The two continuous filament strands were then passed in parallel through a spin-drawing machine and were finally wound upon a bobbin at a speed of 2,800 m/min. The nominal denier of the wound-up yarn was 935 dtex.

In the spin-drawing machine, the filaments were successively passed through the following aggregates: (1) an unheated pre-tension roll about which four wraps or turns were made; (2) a pair of feed rolls heated to 75° C., about which eight turns were made; (3) a system of rolls heated to 100° C., consisting of two rolls of the same geometry as the feed rolls and operating at the same speed as the feed rolls, and about which two turns were made; (4) a pair of draw rolls heated to 195° C. and operating at a speed of 5.1 times the speed of the feed rolls and about which the continuous filaments were wrapped eight times; and, (5) a set of let down or relaxation rolls heated to 100° C. and operating at the same speed as the pair of draw rolls and about which eight turns were made.

The rolls of the roll system were positioned in such a manner that the continuous filaments were able to pass between the feed rolls and the rolls, and between rolls and draw rolls, without collapsing. The distance between the individual turns or wraps was 4 mm.

No disturbances in the drawing process occurred during a prolonged period of time, so that 94% fully wound bobbins, having a weight of 10 kg, were obtained. The yarn characteristic are reported in the Table 1. The yarn produced had a high tenacity, a low break elongation and a low reference elongation. The distribution of tensile strength and elongation values, expressed by the coefficients of variation of the measuring values of different bobbins (CB), was excellent.

EXAMPLE 2

Polyamide-6 filaments were extruded and spin-drawn under the same conditions as in Example 1, except that the roll system was operated at a speed 1.5 times higher than than of the feed rolls, and the speed of the draw rolls was 5.2 times higher than the speed of the feed rolls. Since the feed speed remained unchanged, the windup speed was increased to 2,850 m/min. At this setting of the draw ratio, an extremely high tenacity was obtained.

EXAMPLE 3

Polyamide-6 filaments were extruded and spin-drawn under the same conditions as in Example 1, except that the draw ratio was increased as compared to Example 2. The rolls of the roll system operated at a speed which was 1.5 times higher than that of the feed rolls, and the speed of the draw rolls was 5.25 times higher than the speed of the feed rolls. The windup speed was 2,900 m/min. At this setting of the draw ratio, a high tenacity and a low elongation were obtained.

EXAMPLE 4 (Comparison Example)

Polyamide-6 filaments were extruded, prepared and wound up under the same conditions as in Example 1. The passage of the continuous filament strands through the spin-drawing machine was, contrary to Example 1, as follows: The filaments made six turns around the feed rolls heated to 90° C. The filaments then made six turns around the first pair of draw rolls, which were heated to 195° C. and ran 4.9 times faster than the feed rolls. The filaments subsequently made eight turns about the second pair of draw rolls, which were heated to 195° C. and ran 5.1 times faster than the feed rolls.

By making a high number of turns around the first pair of draw rolls, the first draw point was localized on the feed rolls. The yarn characteristics, as shown in the Table 1, were clearly less favorable then those of Example 1. Also, the uniformity of these values (CB) was poorer. During the drawing operation, problems kept increasing, due to yarn breakage, so that fewer yarn packages were obtained than in Example 1.

EXAMPLE 5 (Comparison Example)

Polyamide-6 filaments were extruded and spin-drawn under the same conditions as in Example 1, except that the rolls were replaced by a stationary snubbing pin, about which the filaments made one turn. Shortly after the filaments were placed upon the pin, the continuous strand broke at the pin. It was impossible to spool the filament strand about the pin for any prolonged period of time which might resemble a continuous operation.

EXAMPLE 6

Polyamide-6 having a relative viscosity $n_{rel}=3.3$ was melted at 289° C. and was extruded at a rate of 385 g/min through a spinneret plate having 193 holes, each hole having a diameter of 0.4 mm.

The extruded filaments were passed through a 600 mm long heater having a wall temperature of 300° C., and were cooled in a 1100 mm long blow duct by a transversely directed air stream blowing at a speed of 1.0 m/sec.

Thereafter a 99% preparation was applied by rolls to the strand of filaments, so that the oil film on the finished feed yarn was 1.2%. The continuous filament strand was then passed through the spin-drawing machine and, finally, was wound up at a speed of 2,980 m/min. The denier of the wound up yarn was 1,400 dtex. In the spin-drawing machine, the yarn was passed successively through the following aggregates: (1) an unheated pre-tension roll around which four turns were made; (2) a pair of feed rolls heated to 93° C., around which 13 turns were made; (3) a roll system having a temperature of 100° C., consisting of two rolls of the same geometry as the feed rolls and operating at the same speed as the feed rolls, around which two turns were made; (4) a pair of draw rolls heated to 195° C. and operating at a speed 5.4 times the speed of the feed rolls, and about which eight turns were made; and, (5) a pair of let down rolls having a temperature of 100° C., around which eight turns were made. The rolls of the roll system were positioned as in Example 1.

There were no draw problems over a prolonged period of time. The number of filled bobbins were more than 92% fully wound. The yarn characteristics are reported in Table 1. They project a feed yarn eminently suitable for technical applications.

EXAMPLE 7 (Comparison Example)

Polyamide-6 filaments were extruded and spin-drawn under the same conditions as in Example 6, except that the temperature of the pair of feed rolls was increased to 125° C. In view of the glass transition point $T_G$ of between 35° and 45° C., the temperature of the feed rolls lies outside the range of the present invention, which is no greater than $T_G+65°$ C.

At a draw ratio of 5.4, a high rate of yarn breakage occurred, so that the draw ratio had to be taken back to 5.2. The resulting yarn characteristics of the finished product were considerably poorer than in Example 6.

EXAMPLE 8

Polyester having a relative viscosity $\eta_{intr}$ of 0.68 was melted at 305° C. and was extruded at a rate of 307 g/min from two spinneret plates, each having 192 holes, each hole having a diameter of 0.4 mm.

The extruded filaments were passed through a 1700 mm long blow duct in which they were cooled by a transversely directed air current flowing at a speed of 0.6 m/sec.

Thereafter, a 99% preparation was applied by rolls to the filaments so that the oil film of the finished yarn was 0.7%. Then, the continuous filament strands were passed in parallel through a spin-drawn machine and were finally wound up at a speed of 3000 m/min. The nominal denier of the wound up yarn was 1100 f 192 dtex.

In the spin-drawing machine, the filaments passed successively through the following aggregates: (1) an unheated pre-tension roll, around which four turns were made; (2) a pair of feed rolls having a temperature of 95° C., about which eight turns were made; (3) a roll system heated to 110° C., consisting of two rolls of the same geometry as the feed rolls and operating at the same speed as the feed rolls, about which the yarn made two turns; (4) a pair of draw rolls heated to 220° C. and operating at a speed 6.1 times faster than that of the feed rolls and about which eight turns were made; and, (5) an unheated let-down roll system, about which eight turns were made, and which operated at a speed 5% slower than the speed of the pair of draw rolls.

The rolls of the roll system were positioned in such a manner that the strands of filaments passed without collapsing between the feed rolls and the rolls, or between the rolls and the draw rolls, and the spacing of the individual turns on the rolls was 4 mm.

No disturbances in the drawing operation occurred over a prolonged period of time. The number of filled bobbins was higher than 92%. The yarn characteristics are summarized in Table 1.

EXAMPLE 9

Example 8 for polyester was repeated, except that the roll system was omitted. The result was a higher yarn breakage caused by erratic running of the continuous filaments. It was not possible to produce yarn packages of any volume.

TABLE 1

| | Example No. | | | | | | | | |
|---|---|---|---|---|---|---|---|---|---|
| | 1 | 2 | 3 | 4 | 5 | 6 | 7 | 8 | 9 |
| Invention/Comparison | Invention | Invention | Invention | Comparison | Comparison | Invention | Comparison | Invention | Comparison |
| Polymer | PA-6 | PA-6 | PA-6 | PA-6 | PA-6 | PA-6 | PA-6 | PET | PET |
| Nominal denier (dtex) | 935f140 | 935f140 | 935f140 | 935f140 | 935f140 | 1400f192 | 1400f192 | 1100f192 | 1100f192 |
| Draw ratio: | | | | | | | | | |
| 1st field 1: | 5.1 | 5.2 | 5.25 | 4.9 | 5.1 | 5.4 | 5.2 | 6.1 | 6.1 |
| total 1: | 5.1 | 5.2 | 5.25 | 5.1 | 5.1 | 5.4 | 5.2 | 6.1 | 6.1 |
| Speed: | | | | | | | | | |
| Rolls: draw rolls | 1:1 | 1.5:1 | 1.5:1 | — | 0+ | 1:1 | 1:1 | 1:1 | — |
| Windup speed (m/min) | 2,800 | 2,850 | 2,900 | 2,800 | 2,800 | 2,950 | 2,850 | 3,000 | 3,000 |
| Temperatures: (°C.) | | | | | | | | | |
| Feed rolls, pair of | 75 | 75 | 75 | 90 | 75 | 95 | 125 | 95 | 95 |
| Roll system | 100 | 100 | 100 | — | unheated+ | 100 | 100 | 110 | 110 |
| 1st pair of draw rolls | 195 | 195 | 195 | 195 | 195 | 195 | 195 | 220 | 220 |
| 2nd pair of draw rolls | — | — | — | 195 | — | — | — | — | — |
| relaxation rolls, pair of | 100 | 100 | 100 | 100 | 100 | 100 | 100 | unheated | unheated |

TABLE 1-continued

| | Example No. | | | | | | | | |
|---|---|---|---|---|---|---|---|---|---|
| | 1 | 2 | 3 | 4 | 5 | 6 | 7 | 8 | 9 |
| Invention/Comparison | Invention | Invention | Invention | Comparison | Comparison | Invention | Comparison | Invention | Comparison |
| Polymer | PA-6 | PA-6 | PA-6 | PA-6 | PA-6 | PA-6 | PA-6 | PET | PET |
| Nominal denier (dtex) | 935f140 | 935f140 | 935f140 | 935f140 | 935f140 | 1400f192 | 1400f192 | 1100f192 | 1100f192 |
| Yarn Turns | | | | | | | | | |
| Pre-tension roll | 4 | 4 | 4 | 4 | 4 | 4 | 4 | 4 | 4 |
| pair of feed rolls | 8 | 8 | 8 | 6 | 8 | 13 | 13 | 8 | 8 |
| pair of rolls | 2 | 2 | 2 | — | 1+ | 2 | 2 | 2 | — |
| 1st pair of draw rolls | 8 | 8 | 8 | 6 | 8 | 8 | 8 | 8 | 8 |
| 2nd pair of draw rolls | — | — | — | 8 | — | — | — | — | — |
| pair of let down rolls | 8 | 8 | 8 | 8 | 8 | 8 | 8 | 8 | 8 |
| Yarn Characteristics | | | | | inoperative | | | | inoperative |
| tenacity (cN/tex) | 86.2 | 89.9 | 90.4 | 81.9 | — | 85.2 | 78.5 | 77 | — |
| break elongation (%) | 20.0 | 19.5 | 18.5 | 22.6 | — | 19.7 | 20.5 | 13.5 | — |
| reference elongation (%) | 8.3 | 8.1 | 8.0 | 8.4 | — | 8.2 | 8.6 | 7.6 | — |
| CB tenacity (%) | 0.75 | 1.2 | 1.0 | 2.4 | — | 1.0 | 2.3 | 0.9 | — |
| CB elongation (%) | 2.3 | 2.2 | 2.4 | 4.9 | — | 2.9 | 5.7 | 2.2 | — |

+rolls were replaced by a stationary snubbing pin

We claim as our invention:

1. An improved process for producing high-tenacity, technical-grade yarns from a polymer by spin-drawing, which comprises (a) extruding the polymer in continuous filament strands into a cooling zone;

(b) passing the filament strands over a preparation device and then over a plurality of roll systems, including feed rolls and draw rolls, the space between these rolls defining a single draw field, said draw field being divided into two zones by at least two intermediate rolls disposed between said feed and draw rolls to provide a self-regulating, localized draw point on said intermediate rolls, whereby all drawing of the filaments takes place on said intermediate rolls and in the zone downstream of said intermediate rolls;

(c) maintaining said feed rolls at a constant temperature of between 20° C. below and 65° C. above the glass transition point of the polymer, said feed rolls serving to heat said filaments to draw temperature;

(d) passing said filaments around said intermediate rolls not more than three turns, thereby permitting said filaments to slide over the surface of the rolls, (e) maintaining said intermediate rolls at a temperature of between 75° C. and 215° C.;

(f) driving at least one of said intermediate rolls at a peripheral speed equal to or greater than the speed of said feed rolls, and less than the speed of said draw rolls, the speed of said draw rolls being at least 5.1 times the speed of said feed rolls;

(g) maintaining the temperature of said draw rolls at at least 160° C., but 20° C. below the melting point of the polymer;

(h) passing the filaments over a let-down roll system maintained at a temperature of at least 20° C. below the melting point of the polymer; and (i) winding up the filaments at a speed greater than or equal to 2,200 m/min.

2. The process of claim 1 in which the let-down roll system is maintained at a temperature less than or equal to 110° C.

3. The process of claim 1 wherein the polymer is selected from the group consisting of polyamide and polyester.

4. The process of claim 1 in which there are two intermediate rolls driven at the same peripheral speed.

5. In an apparatus for producing high-tenacity, technical-grade yarn by spin-drawing, comprising in series a spinneret with a blow-duct,
a preparation system,
a set of feed rolls,
an intermediate roll system,
a set of draw rolls,
a set of relaxation rolls, and
windup means, the improvement wherein said intermediate roll system consists of at least two cylindrical rolls, one being connected to a drive means, said cylindrical rolls being mounted for adjustment in a mutually contrary relationship.

6. The apparatus of claim 5 wherein the axes of said cylindrical rolls are parallel and are adjustable to each other in a skewed relationship of ±15 angular degrees.

* * * * *